United States Patent [19]

Noll

[11] 4,375,224

[45] Mar. 1, 1983

[54] AIR CONDITIONING CONTROL EQUIPMENT

[75] Inventor: R. W. Noll, Santa Rosa, Calif.

[73] Assignee: Acutherm, Inc., Emeryville, Calif.

[21] Appl. No.: 227,146

[22] Filed: Jan. 21, 1981

[51] Int. Cl.[3] ..... F16K 31/365

[52] U.S. Cl. ..... 137/486; 92/48; 137/487.5

[58] Field of Search ..... 92/48, 49, 5 R; 403/DIG. 1; 137/486, 487.5

[56] References Cited

U.S. PATENT DOCUMENTS

| | | | |
|---|---|---|---|
| 2,000,890 | 5/1935 | Hueber et al. | 92/48 X |
| 2,116,646 | 5/1938 | Schmutz | 92/48 X |
| 2,380,983 | 8/1945 | Mock | 92/48 X |
| 2,679,609 | 5/1954 | Fischer et al. | 92/48 X |
| 2,758,494 | 8/1956 | Jenkins | 403/DIG. 1 X |
| 2,914,630 | 11/1959 | Ralston | 92/5 R X |
| 3,077,186 | 2/1963 | De Beaubien et al. | 92/48 |
| 3,378,022 | 4/1968 | Sorenson | 137/81.5 |
| 3,719,321 | 3/1973 | McNabney | 236/49 |
| 3,806,027 | 4/1974 | Ginn et al. | 236/49 |
| 3,862,644 | 1/1975 | Emmons et al. | 137/486 |
| 3,934,795 | 1/1976 | Ginn et al. | 236/13 |
| 3,941,310 | 3/1976 | Travaglio et al. | 236/49 |
| 4,040,564 | 8/1977 | Waeldner et al. | 236/49 |
| 4,077,567 | 3/1978 | Ginn et al. | 236/49 |
| 4,147,298 | 3/1979 | Leemhuis | 236/49 |
| 4,284,237 | 8/1981 | Harris et al. | 236/49 |

*Primary Examiner*—William E. Tapolcai

*Attorney, Agent, or Firm*—Limbach, Limbach & Sutton

[57] ABSTRACT

Method and apparatus for air conditioning control where multiple pressure conditions are added algebraically with independent modular diaphragm systems. The method provides automatic balance of pressure and velocity conditions by adjusting upstream dampers in response to the algebraic difference between static pressure and velocity pressure.

2 Claims, 3 Drawing Figures

CONTROL
10
12
14
16
18
20
22
24
26
28
28A
28B
28C
28D
30
32
34
34A
34B
36
36A
36B
38
40
42
44
46
120
122
124
126
128
130
132
134
136
140
142
144
145
146
148
150

AIR CONDITIONING CONTROL EQUIPMENT

BACKGROUND OF INVENTION

Automatic air conditioning devices have been developed in recent years for automatically opening and closing defusers in response to air conditions in a room. For instance, a product marketed under the trademark THERMA-FUSER ® by Acutherm, Inc. in Novato, Calif. fits on a standard air conditioning duct in place of a standard defuser and automatically changes the defuser discharge opening in response to air temperatures in the room.

Automatic defuser controls of the general type mentioned above have important advantages in providing system flexibility and reducing energy comsumption, but they may create a problem if the system in which they are used is not provided with additional means for making major system adjustments in response to automatic adjustment of many of the THERMA-FUSER ®s. For instance, if a large number of THERMA-FUSER ®s operate to close down their discharge areas at the same time, the resulting reduction in air velocity through supply ducts may cause a substantial increase in duct static pressure and increase velocity and whistling through the defuser.

While a number of air conditioning control units have been provided in the past, none has been provided which offers an efficient and economic solution to this problem.

SUMMARY OF INVENTION

In accordance with this invention I have developed an air conditioning control unit and method which operates directly and efficiently to control duct supply conditions in the situations described above. Additionally, the air conditioning control is constructed in a unique manner which permits it to be fabricated and used in multiple combinations of a basic modular unit. Finally, the new air conditioning control is usable in a wide variety of air conditioning system control situations, for instance, for mass balancing of pressures and air volumes in major parts of the system to avoid the system problems where doors blow open and closed.

The air conditioning control unit of this invention has two pair of independent plenum chambers separated by two diaphragms, and the diaphragms are mechanically coupled together to generate control forces which are the algebraic combinations of multiple pressure conditions. As indicated above, the control unit is preferably built in modular units which each contain a diaphragm and one pair of plenum chambers with mechanical means coupled to the diaphragm for connecting the diaphragm to the diaphragms of like modules. Preferably the mechanical coupling means comprises a permanent magnet attached to the diaphragm and attractable to a permanent magnet on the diaphragm of a like module.

The apparatus of this invention is preferably used with air flow detectors capable of distinguishing between static system pressure at a given location and pressure conditions attributable to air velocity. Preferably the air conditioning detectors are of the type which measure static pressure and total pressure where total pressure is the sum of static pressure and velocity pressure. As used herein, the term "velocity pressure" denotes pressure which increases with increasing air velocity and may be measured directly by a detector facing into the moving air stream. "Velocity pressure" in this sense may also be measured inversely by detectors operating on Bernuli's principle that increasing fluid velocity may generate increased suction in a restricted passage.

Where the air conditioning control of this invention is employed with a detector which detects static pressure and total pressure, the detector may be connected to the control to generate a control force which is a parameter of the static air pressure minus velocity air pressure at a location in the system. Where the control unit connected in this way is used to operate a damper upstream of the detection location, the control unit solves the problem mentioned above which may be encountered with THERMA-FUSER ® installations.

The control unit of this invention with two diaphragms and two independent pairs of plenum chambers may also be used efficiently to provide pressure and volume balances in different parts of a system. For instance, a pressure differential may be provided across one diaphragm which is a function of static pressure at one location in the system and a pressure differential may be provided across the other diaphragm which is a function of static pressure in another part of the system. The mechanical coupling of the two diaphragms provides a common output, through an electrical control switch for instance, which may be used to maintain pressure equalization at the two different locations.

Similarly, the two diaphragms may be connected to detectors which measure both static pressure and total pressure in different parts of the system. The detector outputs may be combined in my new control unit to provide total pressure minus static pressure equals velocity pressure at one location on one diaphragm, and similarly, velocity pressure at the second location on the other diaphragm. The combined output of the detectors then can provide a balancing of velocity pressure in two different ducts, and where the ducts have equal areas, the control provides for maintaining equal air volume flows through the two ducts. This produces important advantages in many situations where, for instance, system efficiency requires that fresh air be pulled into the system from outside to save energy and it is desirable to exhaust an equal amount of air from the system to maintain mass and pressure balances.

These and other features of the invention will become apparent from the following description read in conjunction with the attached drawings in which:

DETAILED DESCRIPTION

Figure 1:
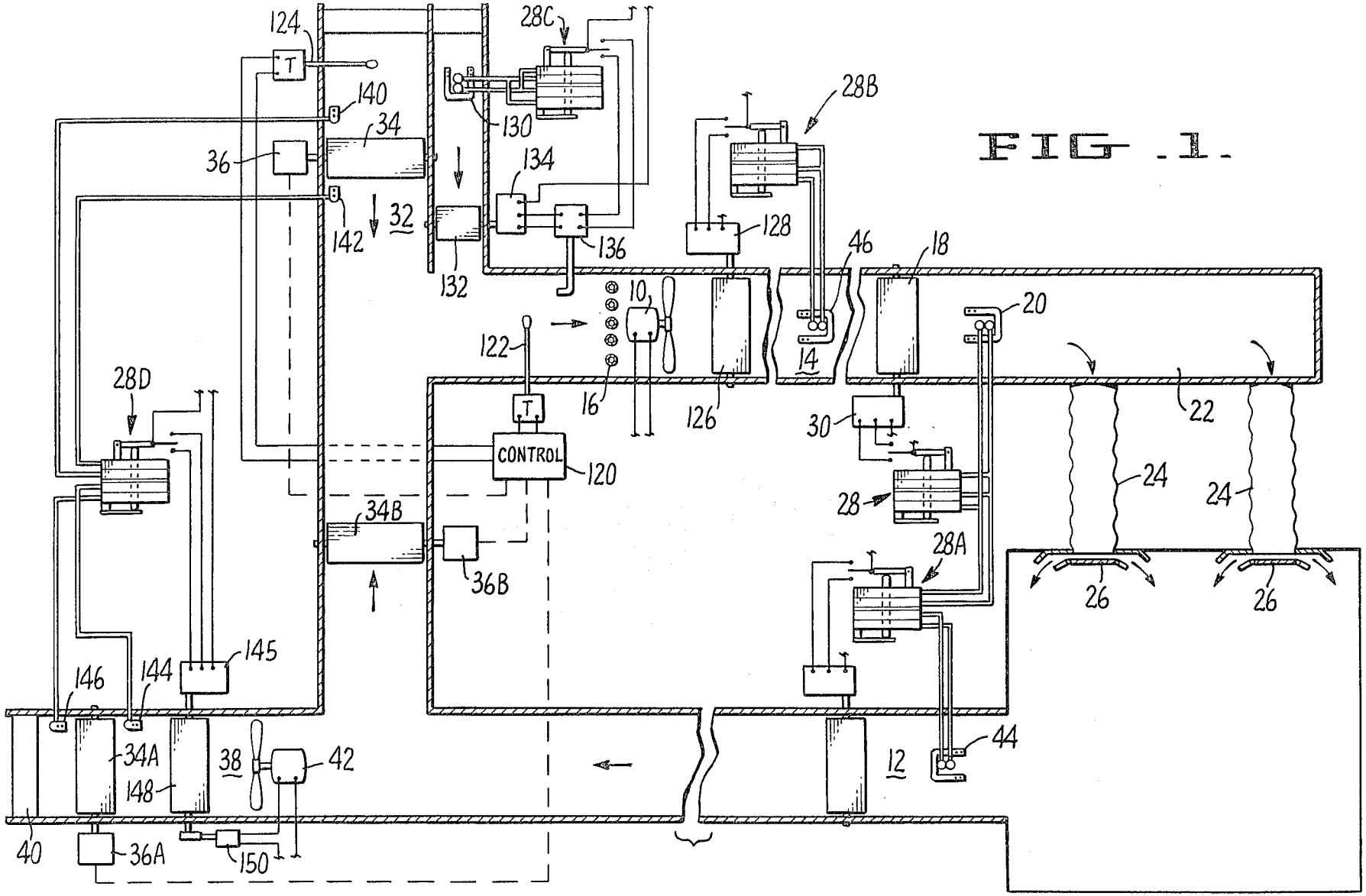
Figure 2:
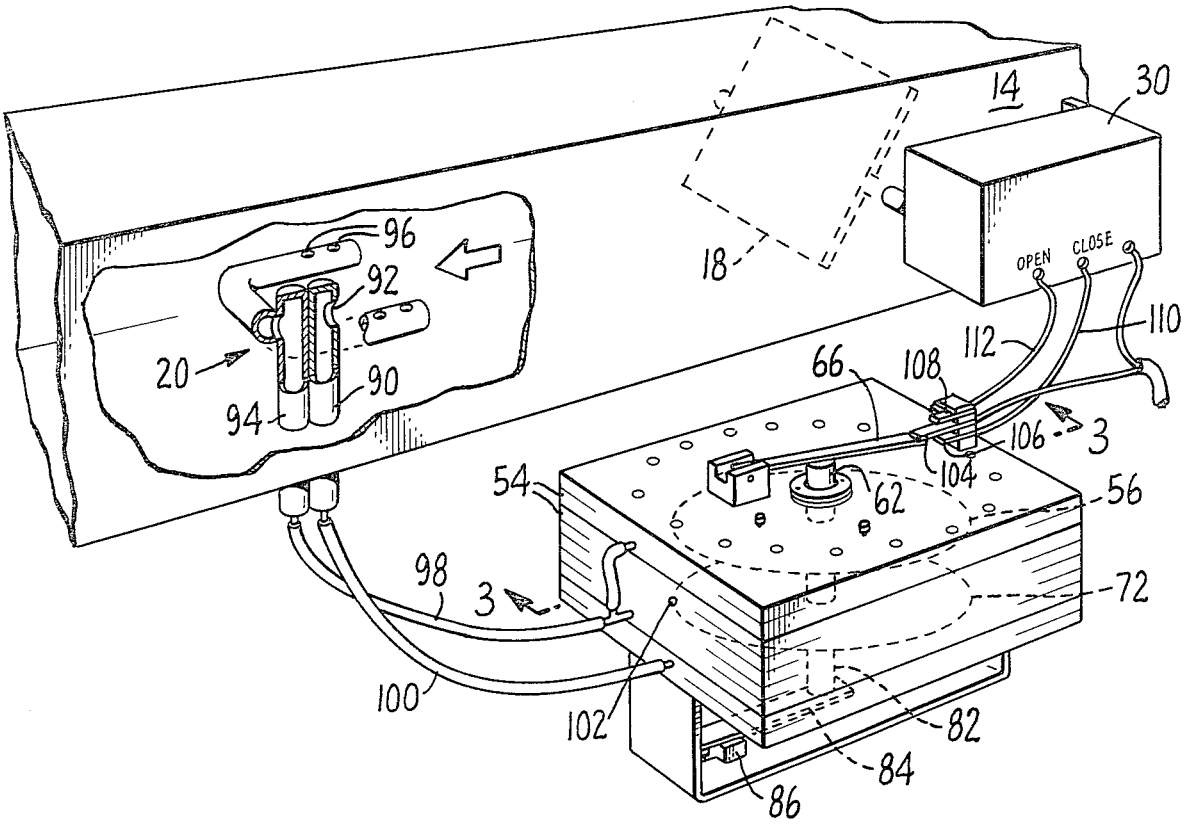
Figure 3:
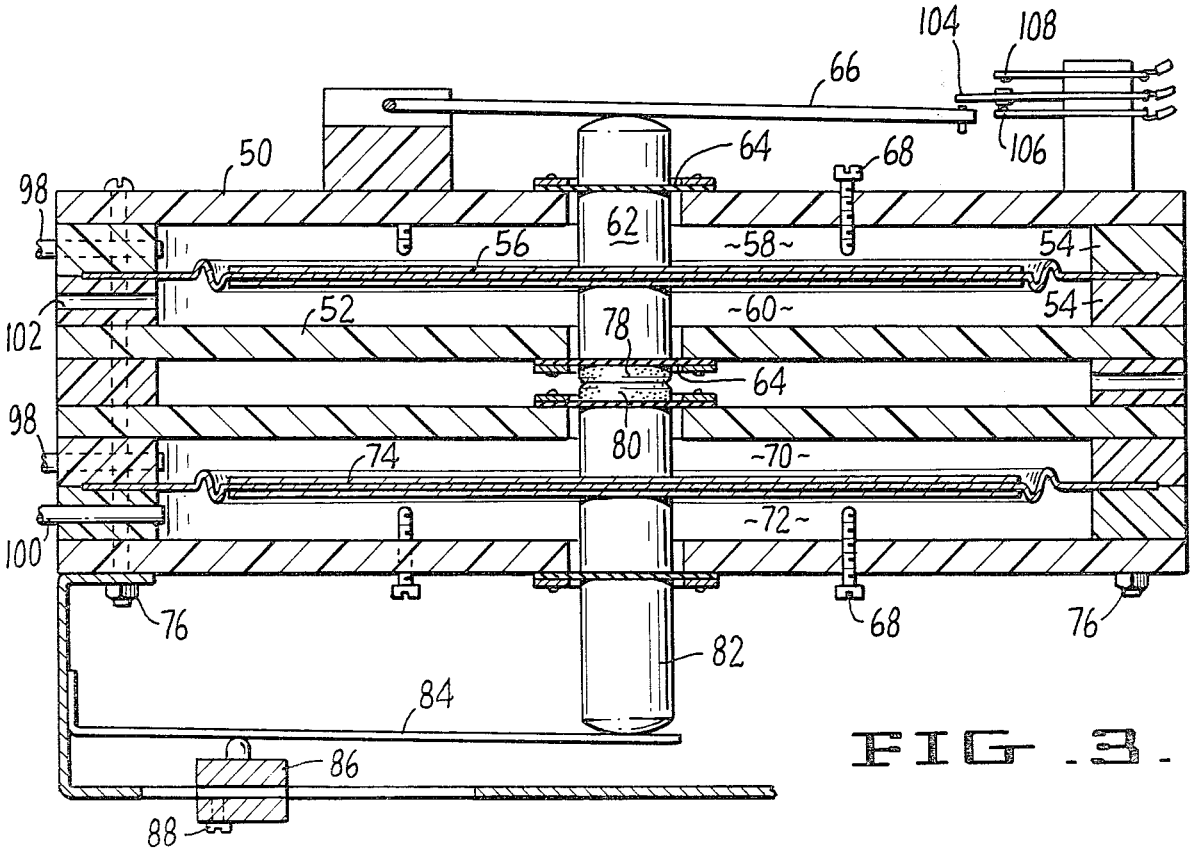

FIG. 1 is a schematic view of an air conditioning system employing control units constructed in accordance with this invention, FIG. 2 is an enlarged view of one of the control units in FIG. 1, and FIG. 3 is a cross-sectional view through the apparatus of FIG. 2 taken across the plane indicated at 3—3.

Referring now in detail to the drawings, the system shown in FIG. 1 includes a main air conditioning fan 10 for moving air from a return duct 12 to a supply duct 14 past heat exchange coils 16. The air in supply duct 14 moves past a damper 18 and a detector 20 to a distribution box 22 and hence through ducts 24 to defusers 26 which are preferably the THERMA-FUSER ®s described above. A control unit 28 constructed in accordance with this invention is connected to the detector 20 as described in greater detail hereinafter and drives a damper motor 30 to open and close damper 18.

As explained in detail below, the system also includes a fresh air inlet 32 controlled by a damper 34 which is operated by an electric motor 36. An exhaust duct 38 is provided with dampers 40 which are normally closed and opened automatically to permit air to escape in response to operation of an exhaust fan 42. The exhaust duct also is provided with a damper 34A driven by a damper motor 36A. A conventional economy cycle control system 120 is connected to a temperature probe 122 in the supply conduit 14, a temperature probe 124 in the fresh air inlet 32 and connected to the inlet mixed air and outlet damper motors 36, 36A and 36B for operation in a conventional manner whereby the dampers 34, 34A and 34B are positioned to circulate fresh air through the system when the outside temperature detected by detector 124 is suitable in relation to the temperature detected by detector 122 and the temperature called for by economizer control 120 to permit economical use of external ambient air.

A control unit 28A like the control unit 28 of this invention is connected to the detector 20 and a detector 44 in the return line 12 to maintain air volume balance in the area supplied by THERMA-FUSER ®s 26 as indicated hereinafter.

A control unit 28B identical to the control unit 28 is connected to a detector 46 in a supply conduit 14 upstream of damper 18 and operates a damper 126 through damper motor 128 to regulate the volume output of fan 10 as explained hereafter.

A fourth control unit 28C constructed like control unit 28 is connected to a detector 130 in the fresh air inlet and controls a damper 132 through a damper motor 134 for maintaining a constant minimum outside air volume as described hereinafter and a pressure responsive double pole, double throw switch 136 for closing the outside air inlet when the fan 10 is turned off and there is no air flow.

A fifth control unit 28D is connected to a pair of static pressure detectors 140 and 142 on opposite sides of damper 34 and a second pair of static pressure detectors 144 and 146 on opposite sides of damper 34A. The electric switch output of control unit 28D operates damper motor 145 to move damper 148, and a limit switch 150 on the shaft of damper 148 turns off fan 42 when the damper is in the closed position. Control 28D operates as explained hereinafter to maintain air volume balance between the inlet duct 32 and the outlet duct 38.

Referring in detail to FIG. 3, the air conditioning control unit of this invention is made up of two modular units. The upper unit consists of body plates 50 and 52 with spacers 54 which support a central diaphragm 56 dividing the interior of the body into a first pair of plenum chambers 58 and 60. A stub shaft 62 is mounted on the diaphragm 56 and provided with air seals 64 where the stub shaft exits from the body. The upper end of the stub shaft 62 engages a switch operator lever 66. Limit screws 68 are provided in the upper wall 56 to limit diaphragm travel.

The lower modular unit of the control assembly in FIG. 3 is made like the upper modular unit with a second pair of plenum chambers 70 and 72 separated by a separate diaphragm 74 corresponding to the plenum chambers 58–60 and diaphragm 56. The two modular units are attached together by bolts 76, and the stub shaft 62 of the two modules are coupled together by a pair of permanent magnets 78 and 80 mounted on the shafts of the two modules. The coupling of the diaphragms together by permanent magnets in this way offers very substantial advantages in fabrication of the control unit because it permits the control units to be made in stacks of 1, 2, 3 or more and also eliminates serious alignment and assembly problems which may be encountered if the shaft 62 is continuous throughout the entire unit. A stub shaft 82 is provided on the bottom of the lower module engaging a spring 84, the tension of which is controlled by a slide 86 which may be moved toward and away from the shaft 82 and locked with a lock nut 88. The various stub shafts 62 and 82 and the magnets 78 and 80 may be mechanically connected together by conventional means such as cement or preferably screws which extend through the air seal 64 clamping the parts on opposite sides of the air seals to each other.

The preferred air detectors used with the apparatus of this invention are shown in FIG. 2 and comprise a first tube 90 having an aperture 92 facing into the air stream for measuring total fluid pressure in the duct. A second tube 94 carries a yoke with a plurality of laterally facing apertures 96 for detecting static pressure in the system. The geometry of the particular detector and the number of holes 92 and 96 which the detector contains may be varied depending upon the size of the ducts.

The static pressure detector 94 is connected by tubes 98 to the chambers 58 and 70 in FIG. 3, and the total pressure detector 90 is connected by a tube 100 to the chamber 72 of the lower diaphragm. Chamber 60 is vented to atmosphere through port 102 so that the upper diaphragm 56 generates a force which is proportional to static pressure. The lower diaphragm develops a force which is proportional to velocity pressure, that is, total pressure from tube 100 minus static pressure from tube 90. In a balanced condition, the switch operator 60 holds central switch blade 104 in a central position between switch contacts 106 and 108. When the switch operator closes the switch contacts 106 or 108, however, the damper motor 30 is actuated to close or open the damper respectively through wires 110 and 112. Thus, in the event that the dampers 26 in FIG. 1 are closed down, the air velocity through duct 14 is reduced and the air pressure increases. The increased static pressure on diaphragm 56 forces the diaphragm downwardly while the decreased velocity pressure on diaphragm 74 augments the downward imbalance. The imbalance causes switch contacts 106 to close, completing a circuit to wire 110 to close down the damper 18 upstream from detector 20 so that the volume of air passing to detector 20 is decreased from resulting reduction in static pressure until a new balance of static pressure minus velocity pressure is obtained. Conversely, when the THERMA-FUSER ®s 26 are opened, velocity pressure will increase while static pressure is reduced to cause an upward net force on the coupled diaphragms to open the damper 18 and again restore a new balance to static pressure minus velocity pressure. In this way the control unit 28 operates to maintain smooth system operation over the varying conditions of THERMA-FUSER ®s 26 and eliminate air whistling and the like.

The control unit 28A in FIG. 1 is identical in construction to the control unit 28, and the plenum chambers on opposite sides of the upper diaphragm are connected as illustrated to apply a downward force on the upper diaphragm which is proportional to the velocity pressure in the supply duct 14. The plenum chambers in the lower module of control unit 28A apply a force to the lower diaphragm which is proportional to the velocity pressure in the return duct 12, so that the electrical output of the control unit 28A may be used to operate the damper motor 152 to regulate damper 154 and maintain air balance in the room where THERMAFUSER ®s 26 discharge.

Control unit 28B is connected to detector 46 so that the plenum chambers in the lower module of control unit 28B apply a force to the lower diaphragm which is proportional to the velocity pressure in duct 14, and the diaphragm in the upper module carries an opposing force proportional to static pressure. In this way control unit 28B regulates the position of damper 126 to maintain a constant velocity pressure minus static pressure upstream from damper 18. As is well-known in the art, the regulation of damper 126 immediately downstream of the main supply fan 10 could be accomplished instead by a variable speed control on fan motor 10 without damper 126, but in many instances it is important economically to provide a constant speed fan with a regulating damper. As indicated in FIG. 1, duct 14 may lead from detector 46 to a number of branch ducts containing damper 18 and detector 20. The detector 46 and its control unit 28B operate to control the main air supply where gross changes in air supply requirement may be caused by a number of dampers 18.

Both the upper and lower modules of control unit 28C are connected to detector 130 in the same way so that the two diaphragms provide a force proportional to double the velocity pressure at detector 130 for regulating damper 132. This provides for injection into the system of a constant volume of fresh air to maintain a constant system pressure. The pressure switch 136 operates to reverse the polarity of damper 134 in the event that the main fan 10 is shut off, thereby preventing cold air from entering the system and freezing pipes when the system is shut down.

The control unit 28D is connected to its pressure detectors as illustrated to provide constant pressure differential across the dampers 34 and 34A so that system air balance is maintained during economizing operations where fresh air is drawn in from the outside. The output of control unit 28D operates the combination of fan 42 and its control damper 148, but as explained above, a conventional variable speed motor control could be used.

It will be apparent to those skilled in the art that the control module of this invention may be used in a variety of ways for an efficient air conditioning system control. Five of these ways are illustrated in FIG. 1, and obviously a variety of even more sophisticated control functions may be obtained where three of the modules are coupled together and where the controls operate pneumatic control circuits instead of electrical control circuits.

While certain specific embodiments of the invention have been illustrated and described in detail, it is obvious that a wide variety of modifications may be made without departing from the spirit and scope of the claims.

What is claimed is:

1. A pressure control for controlling the air flow in a duct of an air conditioning system comprising:

a first pair of plenum chambers;

a first diaphragm forming a common wall between the chambers of the first pair for developing a force proportional to the pressure differential between the chambers;

a second pair of plenum chambers;

a second diaphragm forming a common wall between the chambers of the second pair for developing a force proportional to the pressure differential between the chambers;

mechanical means coupling the diaphragms together for combining the forces;

spring means coupled to said mechanical means for opposing the combined force of the diaphragms;

electrical switch means coupled to the mechanical means for controlling an electrical circuit in response to the position of the mechanical means;

means coupled to the first pair of plenum chambers for applying to the first diaphragm a pressure differential which is a parameter of the static pressure in the duct, means coupled to the second pair of plenum chambers for applying to the second diaphragm a pressure differential which is a parameter of the air velocity in the duct with the two pressure differentials connected in opposition to each other by the mechanical means, and control means connected to the electrical switch means for altering fluid flow in the duct responsive to operation of the switch.

2. The apparatus of claim 1 in which said mechanical means comprises a first magnet attached to the first diaphragm and a second magnet attached to the second diaphragm with said magnets attracted to each other.

* * * * *